United States Patent [19]

Kern et al.

[11] 4,343,153

[45] Aug. 10, 1982

[54] ANTI-SUPERCHARGE PRESSURE VALVE

[75] Inventors: Calvin V. Kern, Maumee; Bruce W. Mitton, Fayette, both of Ohio

[73] Assignee: Eltra Corporation, Toledo, Ohio

[21] Appl. No.: 132,555

[22] Filed: Mar. 21, 1980

[51] Int. Cl.[3] ..... F15B 13/042

[52] U.S. Cl. ..... 60/460; 60/475; 60/476

[58] Field of Search ..... 60/475, 476, 460; 91/420

[56] References Cited

U.S. PATENT DOCUMENTS

| | | | |
|---|---|---|---|
| 1,812,587 | 6/1931 | Ellis . | |
| 2,467,508 | 4/1949 | Trautman | 60/475 X |
| 2,679,727 | 6/1954 | McLeod | 60/475 X |
| 2,759,456 | 8/1956 | Court . | |
| 2,931,176 | 4/1960 | Bloch et al. . | |
| 3,234,968 | 2/1966 | Frantz | 137/625 X |
| 3,408,035 | 10/1968 | Lathrop et al. | 60/476 X |
| 3,411,294 | 11/1968 | Hedermann | 60/475 X |
| 3,640,068 | 2/1972 | Mann | 60/475 |
| 3,747,351 | 7/1973 | Wilkerson et al. | 60/476 |
| 3,795,178 | 3/1974 | Roche | 91/42 D |

*Primary Examiner*—Irwin C. Cohen
*Attorney, Agent, or Firm*—James P. DeClercq

[57] ABSTRACT

Means are disclosed for dissipating supercharge pressure in a hydraulic system including a reversible pump (18) directly connected to a hydraulic cylinder (22). Supercharge pressure results from unequal areas on either side of a piston (24) of a single-ended hydraulic cylinder (22). When the piston moves towards the blind end of the cylinder (22), more fluid is displaced from the cylinder than is admitted to the cylinder on the opposite side of the piston. Means responsive to a pressure at a first port (82) of the pump (18) opens a passage between the second port (76) of the pump (18) and a fluid reservoir (16), allowing fluid in excess of the pump's intake requirements to pass to the reservoir (16). In a first embodiment of the invention, a rocker mechanism (60) is actuated by a piston (66) responsive to pressure at the first port (82) pressing against a first end (20) of the rocker mechanism (60), the second end (74) of the rocker mechanism (60) displacing a check ball (38) of a keep-full valve. In a second embodiment of the invention, passages (126, 128) are provided in a pilot piston (106) for pilot-operated check valves (42, 44), so that when the piston (106), in response to pressure at the first port (82), opens a check valve (42), to allow fluid to return from the cylinder (22), passages (126, 128) in the piston (106), opening upon the face (129) of the pilot piston (106) adjacent the check valve, become aligned with a passage (130) to the reservoir (16), allowing excess or supercharge oil to flow to the reservoir (16).

2 Claims, 2 Drawing Figures

ANTI-SUPERCHARGE PRESSURE VALVE

This invention relates to the control of hydraulic cylinders. More particularly, the instant invention relates to a structure for a valve which compensates for the difference in volume of two ends of a cylinder, separated by a piston, due to the presence of a rod attached to the piston and extending from one end of the cylinder, particularly suitable for use with trim and tilt systems for outboard drives on small boats.

BACKGROUND OF THE INVENTION

A hydraulic or pneumatic cylinder, having an actuating rod extending from one end, is known as a single-ended cylinder, with the end of the cylinder having the rod referred to as the rod end, and the opposite end referred to as the blind end. Due to the presence of the rod attached to the cylinder piston, the volume for hydraulic fluid differs on either side of the piston. More importantly, the rate of change of volume, or the flow of hydraulic fluid, differs as the piston is moved in either direction. In a system where the cylinder is directly connected to a reversible pump, when the cylinder is being actuated to extend the rod, the fluid flowing from the rod-end of the cylinder is less than that required to be supplied by the pump to the blind end of the cylinder, for a particular rate of extension of the cylinder. Typically, the pump draws additional working fluid from a reservoir to supply this excess fluid, often through the same path that originally supplied working fluid to the pump, to initially fill the system with the working fluid. This may be a one-way valve between the pump and the reservoir.

When the cylinder is actuated to retract the rod, a greater flow of fluid leaves the blind end of the cylinder than is being supplied to the rod end of the cylinder. This excess return flow pressurizes the inlet of the pump. This excess pressure is known as superchange pressure. Since a pump has inherent leakage, this inherent leakage may be relied on to relieve the excess pressure at the inlet of the pump, passing this additional fluid to the reservoir through the pump's drain outlet. However, in a well-made, energy efficient pump, the inherent leakage is low, so that a relief valve is provided at the inlet or outlet of the pump to return excess fluid to the reservoir. This wastes energy in converting supercharge pressure to heat in the relief valve, and in slowing cylinder rod retraction. This is most important in mobile applications, such as trim and tilt units for outboard motors on small boats, where the power is supplied from an intermittent duty motor, where high electrical currents are involved, and heating and increased electrical resistance losses result from increased operation time.

In more complex and expensive systems, a constant-pressure pump is used, and the direction of cylinder rod travel is determined by a separate reversing valve connected to the cylinder, and to the pump and reservoir. In such a system, any excess fluid is passed to, or pulled from, the reservoir through the reversing valve. However, a constant pressure pump operates by generating a higher pressure than desired, and regulating the pressure down to the desired valve by dissipating the excess pressure in a back-pressure or relief valve. This type of system is capable of providing substantially equal speeds of extension and retraction of a cylinder's actuating rod, since the pump flow is whatever is necessary to maintain the predetermined pressure. However, such a system, besides requiring additional heavy and expensive components, is unsuitable where energy consumption is important, due to the energy lost in the regulating valve, converting excess pump pressure to heat, and the decreased efficiency of a higher pressure pump.

Applicant's invention overcomes these and other deficiencies of known hydraulic systems.

SUMMARY OF THE INVENTION

The instant invention provides a simple valve structure for use in conjunction with a reversible pump and a single-ended hydraulic cylinder which allows the actuating rod of the cylinder to move at a higher rate of speed in its retraction direction, without wasting energy in overcoming biasing forces of relief valves and the like, or from temperature-dependent losses in electrical devices, while allowing the use of smaller and lighter electrical motors and wiring.

It is an object of the invention to produce such a structure which also blocks oil flow to or from the cylinder when the pump is not operating, to maintain the cylinder in position against external loads unless movement is desired.

It is a further object of the invention to produce such a structure that increases rate of cylinder rod retraction by 20 to 30 percent over that obtained without the use of the invention.

It is a further object of the invention to provide such a structure which is easy to manufacture, involves little additional cost, and is reliable in use.

DESCRIPTION OF THE PREFERRED EMBODIMENTS

Figure 1:
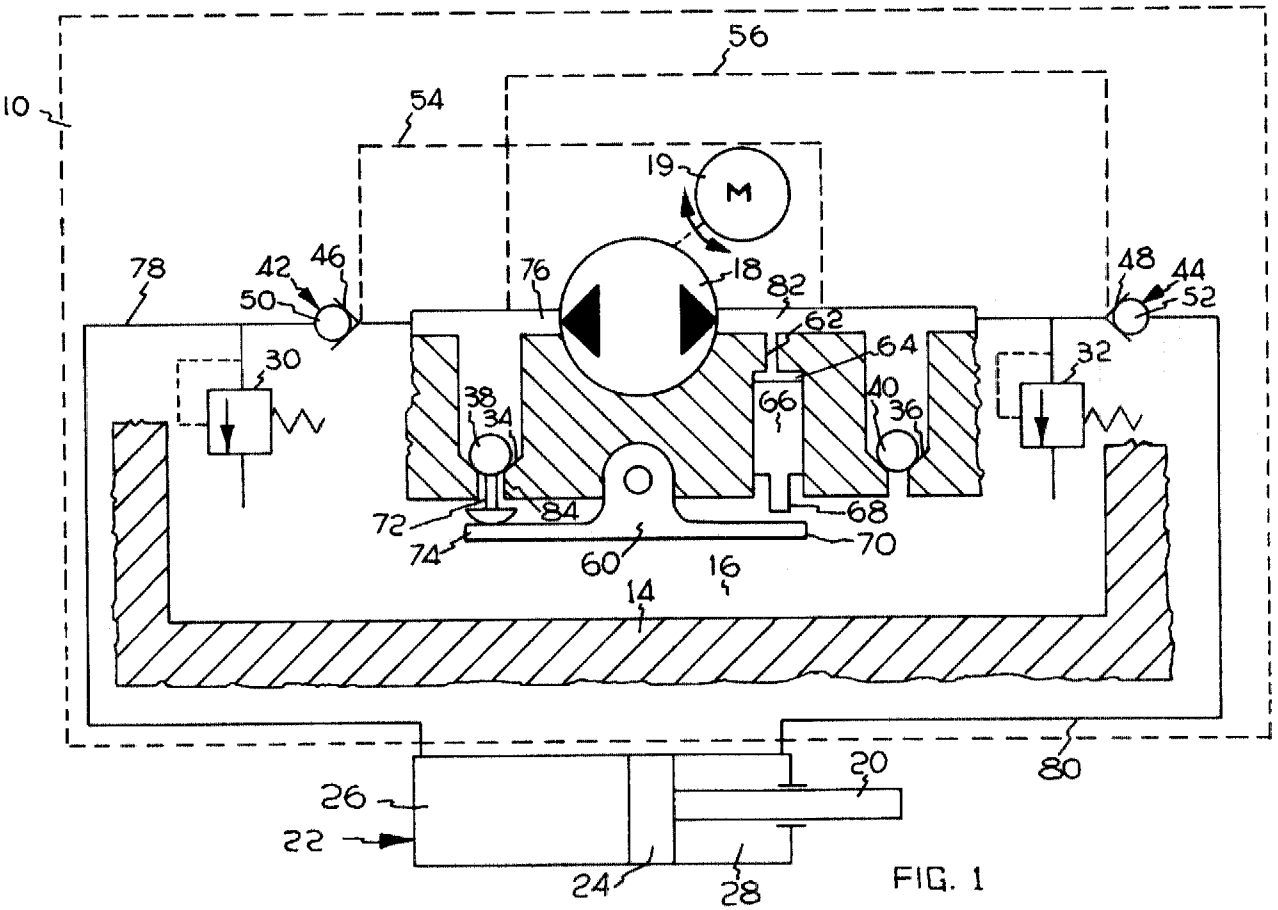
FIG. 1 is a schematic illustration of a first embodiment of the invention.
Figure 2:
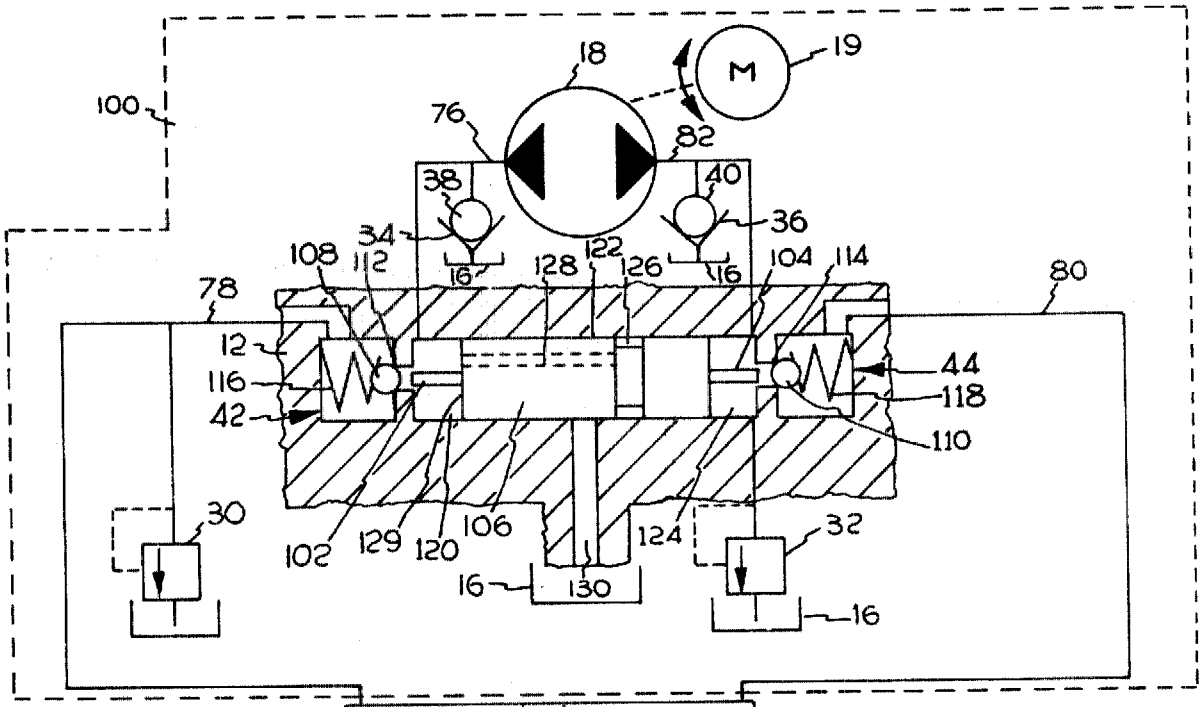
FIG. 2 is a schematic illustration of a second embodiment of the invention.

FIGS. 1 and 2 illustrate, using both schematic sectional views and standard hydraulic symbols, two different preferred embodiments of the invention. Both embodiments illustrated are preferrably modifications to a standard, commercially available pump assembly. Therefore, identical numbers will be used for identical parts wherever possible, although they may be shown as hydraulic symbols in one figure and as schematic or sectional views in another.

FIG. 1 shows a first preferred embodiment of the invention, wherein a rocker mechanism senses the pressure of hydraulic fluid tending to cause a cylinder rod to retract, and opens a valve which will allow excess oil returning from the blind end of the cylinder to flow to the reservoir. In the preferred embodiment, all hydraulic components are part of a single assembly, although obviously they may be separate components.

Referring to FIG. 1, a pump assembly 10 includes a body portion 12, and a reservoir housing 14, forming a reservoir 16 containing a supply of hydraulic fluid. A reversible hydraulic pump 18 is driven by a reversible motor 19, to cause extension and retraction of a rod 20 of a cylinder 22, shown as differential piston type, having a rod 20 and a piston 24, to clearly illustrate the function of the invention. Piston 24 divides cylinder 22 into a blind-end chamber 26 and a rod-end chamber 28.

Pump assembly 10 is provided with pressure relief valves 30 and 32, to prevent excess pressurization of the hydraulic system, by passing hydraulic fluid under excessive pressure to reservoir 16. Pressure relief valves 30 or 32 also serve as the conventional means for relieving supercharge pressure. Pump assembly 10 is also provided with so called "make-up" or "keep-full" valves, shown as valve seats 34 and 36 formed in body 12 and check balls 38 and 40, movable against seats 34 and 36, respectively. Pilot-operated check valves 42 and 44, are shown as having seat means 46 and 48, blocking means 50 and 52, and pilot means 54 and 56, respectively. Body 12 is provided with a pivot 58, upon which a rocker 60 is tiltably mounted. Body 12 is provided with a passage 62, and a bore 64 connected to passage 62. A piston 66 is disposed within bore 64, and has an extension 68 adapted to press against an end 70 of rocker 60. A pusher 72 is interposed between ball 38 and end 74 of rocker 60, so that ball 38 may be displaced by pivotial movement of rocker 60.

In the description which follows, reference will be made to direction of movement of various physical items depicted. Note that such directions are intended as an explanation of function, and not as limitions of the scope of the invention.

For example, should it be desired that rod 20 be extended from cylinder 22, motor 19 would be rotated to cause hydraulic pressure to appear at port 76 of pump 18. Pressure at port 76, acting through pilot means 56, opens pilot operated check valve 44, and also opens check valve 42. Ball 38 is pressed against seat 34 by pressure at port 76. Fluid under pressure at port 76 pushes check valve 42 open, and flows through line 78 to chamber 26 of cylinder 22, pushing piston 24 to the right. Fluid from chamber 28 is forced through line 80, through check valve 44, to port 82 of motor 18. By inspection it can be observed that, under these conditions, more hydraulic fluid is being supplied to chamber 26 than is being returned from chamber 28 of cylinder 22. This will result in a suction at port 82 of motor 18, and pull the required additional fluid from reservoir 16, by lifting ball 40 from seat 36. This replenishment does not result in any significant energy losses.

Should it be desired to cause rod 20 to retract, the pump 18 is rotated to cause fluid under pressure at port 82. Fluid under pressure at port 82 opens check valve 42 through pilot means 54, and forces check valve 44 open. Fluid under pressure at port 82 also flows through passage 62 into bore 64, forcing piston 66 downward, forcing extension 68 against end 70 of rocker 60. Rocker 60 pivots about pivot 58, causing end 74 to move upwards, pressing against pusher 72, which displaces ball 38 from seat 34. Hydraulic fluid under pressure then flows from port 82 through check valve 44 and line 80, to chamber 28 of cylinder 22, forcing piston 24 to the left. Movement of piston 24 forces hydraulic fluid from chamber 26 of cylinder 22, through line 78 and check valve 50, toward port 76 of motor 18. By inspection, it will be noted that a substantially larger flow of hydraulic fluid from chamber 26 is caused by movement of piston 24, than the amount of fluid supplied to chamber 28 to cause that motion of piston 24. This results in an additional, or supercharge, pressure, in line 78, since pump 18 can not accept more fluid at port 76 than is being emitted at port 82. Conventionally, this excess pressure would be dissipated through pressure relief valve 30 or 32, to reservoir 16. This wastes energy by transforming excess pressure to heat, and also causes the pump 18 to operate at a higher pressure, where it is less efficient, resulting in a relatively slow retraction of rod 20, and increased power requirements to drive pump 18. In this regard, it should be noted that, in the disclosed illustrative use of the invention, pressure relief valve 30 is usually set to operate at a substantially higher pressure than pressure relief valve 32, so that the pressure of fluid at pump port 76 would be referred to pump port 82, excess fluid then flowing to reservoir 16 through pressure relief valve 32.

However, with the invention, this excess or supercharge oil flows to reservoir 16 past ball 38, displaced by pusher 72, and around pusher 72, which has a lesser diameter than the diameter of an aperture 84 in seat 34. By these means, supercharge pressure is dissipated without waste of energy. In an actual physical embodiment, used in conjunction with a hydraulic trim and tilt mechanism for an outboard drive unit for a boat, the outboard unit was caused to lower approximately 20 to 30 percent faster than previously, with the current required to drive an electric motor 19 powering pump 18 reduced from approximately 110 amps at 12 volts, to approximately 90 amps at 12 volts. It can thus be seen that smaller wires would be satisfactory to avoid excessive voltage losses, and that reduced heating of all components results in increasing their efficiency.

FIG. 2 shows an alternate embodiment, wherein the pilot means for pilot operated check valves 42 and 44 serves to uncover a path to reservoir 16 for excess oil. In FIG. 2, pilot means 54 and 56 are shown as including projections 102 and 104 on pilot piston 106, which bear against balls 108 and 110, respectively, to push balls 108 and 110 from seats 112 and 114, against springs 116 and 118. It should be noted that, while ball-type check valves as illustrated may be used successfully, it would be obvious to substitute various other types of pilot operated check valves. Some suitable check valves are described in U.S. Pat. Nos. 3,473,326, Oct. 32, 1969 and 3,504,882, Apr. 7, 1970, both issued to William S. Vargo and assigned to the instant assignee, entitled *UNITARY HYDRAULIC SHOCK ABSORBER AND ACTUATOR* and *HIGH-PRESSURE HYDRAULIC SYSTEM* respectively, both hereby incorporated by reference.

In both FIGS. 1 and 2, it should be noted that when pump 18 is not operating, piston 24, and rod 20, are prevented from movement, check valve 42 and 44 both being closed. However, should a severe force be applied to rod 20, causing it to move, or should pump 18 be energized when piston 24 has reached an end of cylinder 22, or is otherwise prevented from moving, excess pressure will be prevented by pressure relief valves 30 and 32.

Referring particularly to FIG. 2, let it be assumed that it is desired to cause rod 20 to extend from cylinder 22, by causing piston 24 to move to the right. Pump 18 is energized to cause hydraulic pressure at port 76. Fluid under pressure at port 76 enters chamber 120 of pilot valve bore 122, forcing pilot piston 106 to the right. This causes projection 104 to open check valve 44. Hydraulic fluid under pressure then flows from chamber 120, opening check valve 42 and flowing through line 78 to chamber 26 of cylinder 22. As piston 24 moves to the right, hydraulic fluid will be displaced from chamber 28 of cylinder 22, through line 80, through open check valve 44, into chamber 124 of valve bore 122, and then to port 82 of motor 18. By inspection, it will be noted that hydraulic fluid is being displaced at a lower rate from chamber 28 than is being supplied to chamber 26, implying that pump 18 must obtain additional fluid from reservoir 16 to provide additional fluid to chamber 26. This additional fluid is provided by the suction appearing at port 82 of motor 18 displacing ball 40 from seat 36, and allowing oil to flow from reservoir 16 to port 82 of motor 18.

Should it be desired to cause rod 20 of cylinder 22 to retract, pump 18 is operated to cause hydraulic pressure to appear at port 82. Hydraulic fluid under pressure flows from port 82 into chamber 124 of piston bore 122, forcing pilot piston 106 to the left, so that projection 102 opens pilot operated check valve 42, displacing ball 108 from seat 112.

In accordance with the invention, piston 106 is provided with a circumferential groove 126, and lengthwise aperture 128 connecting groove 126 with the face 129 of piston 106 adjacent projection 102, and chamber 120 in valve bore 122. As piston 106 is moved to the left in FIG. 2, groove 126 moves into alignment with aperture 130, formed in body portion 12, connecting bore 122, and reservoir 16. In this manner, piston 106 serves as a means for blocking a passage between a pump port and the reservoir, while aperture 128 and groove 126 serve as a means for opening the passage, just as the piston-and-rocker arrangement of FIG. 1 served as means for opening the passage blocked by ball 38 against seal 34.

Hydraulic fluid under pressure then flows from port 82, through chamber 124, through check valve 44 and line 80, to chamber 28 of cylinder 22, causing piston 24 to move. By this movement of piston 24, fluid flows toward port 76 of motor 18 through line 78. It will be seen that more hydraulic fluid is being returned from chamber 26 than is being supplied to chamber 28. Rather than being wastefully dissipated through pressure relief valve 30 or 32, this fluid flows through check valve 42, into chamber 120, through aperture 128 to circumferential groove 126, and then to reservoir 16 through aperture 130. Although, in an actual physical embodiment of the invention, passages are sized so that there will still be adequate pressure in chamber 120 to supply port 76 of pump 18, it will be apparent that suction occuring at port 76 of pump 18 will draw any required fluid from reservoir 16 by displacing ball 38 from seat 34.

It has been found that the arrangement discribed with regard to FIG. 2 has produced the same advantages as the embodiment described in FIG. 1, in reducing power required, heating and component sizes, and increasing efficiency and speed of movement, etc.

As will be apparent to one skilled in the art, numerous modifications and variations of the disclosed embodiments of the invention may be made without departing from the scope of the invention.

We claim:

1. A device for moving and maintaining the position of a load moveable in at least two directions, comprising:

a supply of fluid;

a reversible pump connected to said supply of fluid, having a first port and a second port;

a cylinder operably connected to said pump and having a piston dividing said cylinder into a first chamber and a second chamber, said piston having a rod attached thereto, said rod extending through said first chamber and outside said cylinder;

valve means operably connected between said cylinder and said pump;

said valve means including a unitary pilot means, said pilot means being a piston means moveable in response to pressurized fluid from said pump, said piston means having a first portion and a second portion;

first and second check valve means adjacent respective said first and second portions of said piston means and operable respectively thereby to allow flow of said fluid from said first and second chambers of said cylinder, respectively, to said pump, each said check valve means being operably connected to said pump and to said cylinder;

said valve means including a conduit interposed between said second port and said supply of fluid, and includes means for blocking said conduit and means responsive to pressure at said first port for opening said conduit;

said piston means being interposed in said conduit;

said piston means including an annular groove formed in said piston means and a passage formed in said piston means between said second portion thereof and said annular groove and being in continuous communication therewith;

said conduit being blocked and said first check valve being operated by said piston means when said piston means is in a first position responsive to pressure at said second port applied to said second portion, and said axial passage and annular groove being interposed in said conduit to open said conduit and said second check valve being operated by said piston means when said piston means is in a second position in response to pressure at said first port applied to said first portion.

2. A device for moving and maintaining the position of a load moveable in at least two directions, comprising:

a supply of fluid;

a reversible pump connected to said supply of fluid, and having a first port and a second port;

means for driving said reversible pump;

a cylinder connected to said load and to said pump and having a piston dividing said cylinder into a first chamber and a second chamber;

said piston having a rod attached thereto, said rod extending through said first chamber and outside said cylinder;

valve means connected between said cylinder and said pump;

said valve means including a unitary pilot means having first and second projections at the ends thereof;

first and second check valves in said valve means disposed adjacent said projections and operable thereby;

said first check valve being connected to said first chamber and said second check valve being connected to said second chamber;

said unitary pilot means being responsive to pressure from said first port of said pump to open said second check valve and responsive to pressure from said second port to open said first check valve;

a conduit between said valve means and said supply of fluid;

an annular groove being formed in said pilot means;

an axial pressure being formed in said pilot means between an end thereof adjacent said second projection open to said second part and said annular groove, said second port, said axial passage, and said annular groove being in continuous communication with one another;

said annular groove and said conduit being in alignment when said pilot means opens said second check valve in response to pressure at said first port for allowing a flow of said fluid from said end of said pilot means through said axial passage and said annular groove to said conduit;

operation of said pump in a first direction by said means for driving said pump causing fluid pressure at said second port, said fluid flowing thereby from said second port through said second check valve to said second chamber, and fluid flowing from said first chamber, through said first check valve operated by said first projection, to said first port, to extend said rod, and operation of said pump in a second direction causes pressure at said first port, said fluid flowing thereby from said first port, through said first check valve to said first chamber, and fluid flowing from said second chamber to said second port of said pump through said second check valve opened by said second projection, and to said supply of fluid through said axial passage and said annular groove and said conduit between said valve means and said supply of fluid, responsive to pressure at said first port, to retract said cylinder rod.

* * * * *